United States Patent [19]

Inman

[11] 4,397,578

[45] Aug. 9, 1983

[54] UNDERSEA PLATFORM CONSTRUCTION SYSTEM

[76] Inventor: Calvin R. Inman, 20 W. Mosoholu Pkwy., S. Bronx, N.Y. 10468

[21] Appl. No.: 235,501

[22] Filed: Feb. 18, 1981

[51] Int. Cl.[3] ..... E02B 3/06

[52] U.S. Cl. ..... 405/33; 52/290; 405/195

[58] Field of Search ..... 405/195, 33, 273, 284, 405/285, 286; 52/290, 300

[56] References Cited

U.S. PATENT DOCUMENTS

| | | | |
|---|---|---|---|
| 1,002,161 | 8/1911 | Lambert | 405/33 |
| 3,435,576 | 4/1969 | Giannelia | 52/300 |
| 3,643,392 | 2/1972 | Martinez | 52/590 X |
| 3,956,862 | 5/1976 | Alexandre | 52/590 X |
| 4,041,660 | 8/1977 | Yensen | 52/590 X |
| 4,189,252 | 2/1980 | Inman | 405/33 |

FOREIGN PATENT DOCUMENTS

| | | | |
|---|---|---|---|
| 959226 | 9/1949 | France | 52/300 |

*Primary Examiner*—Dennis L. Taylor

[57] ABSTRACT

This invention relates to a V-Block and an underwater construction comprising said V-Block which is capable of forming an undersea platform construction system. The V-Block is comprised of an elongated lower anchor member, two legs of unequal length contiguous with and extending upwardly and outwardly from said anchor and upper arms contiguous with the terminous of each of the two legs. The elongated lower anchor member has means for interlocking with adjacent anchor members and the two arms also have means of interlocking with adjacent arms of the other V-Blocks. A more complex underwater platform construction system is also disclosed.

5 Claims, 12 Drawing Figures

FIG.1
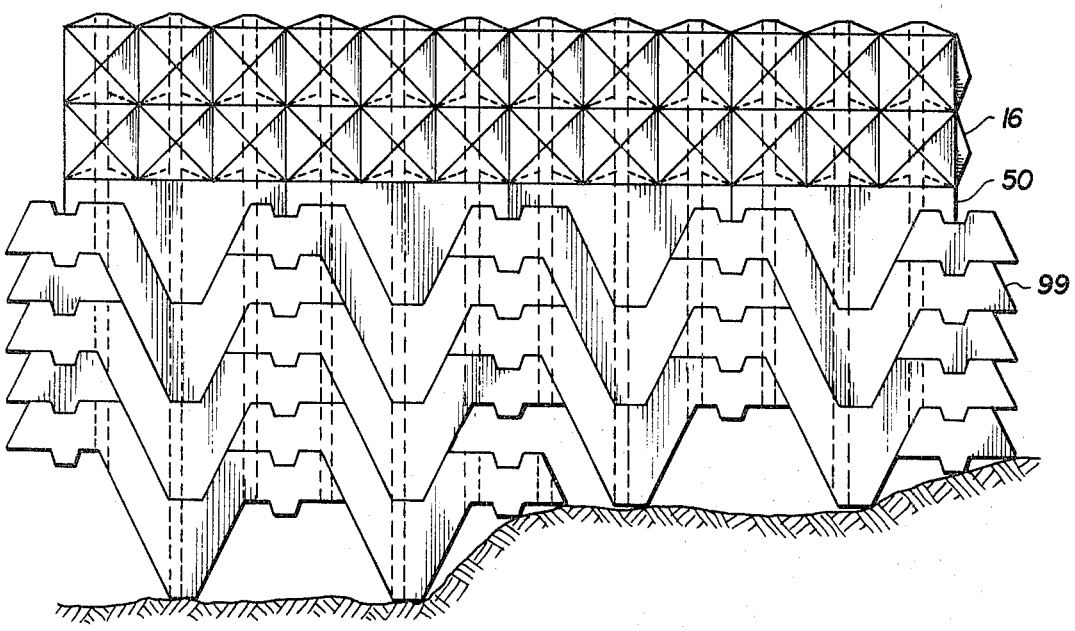
FIG.2
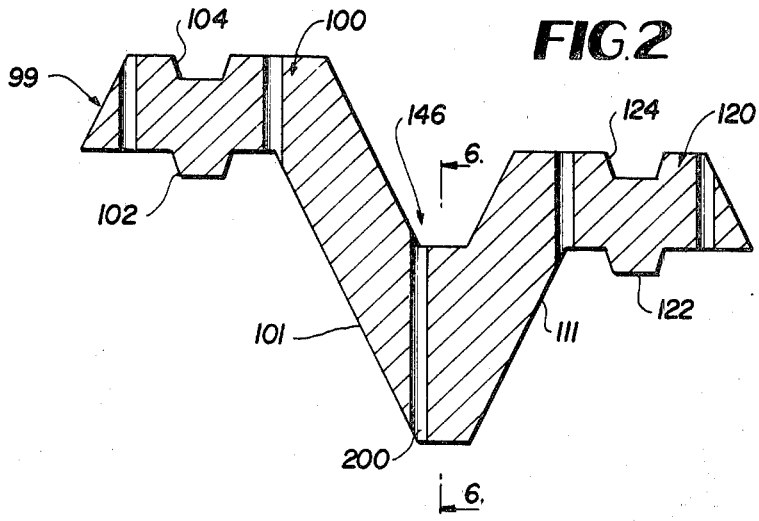
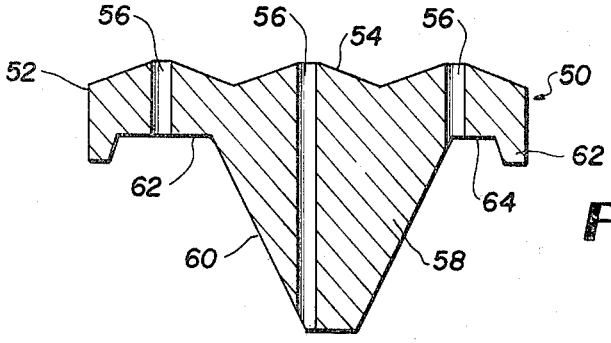
FIG.3

UNDERSEA PLATFORM CONSTRUCTION SYSTEM

CROSS-REFERENCE TO RELATED APPLICATIONS

This application is related to application, Ser. No. 938,757, filed Sept. 1, 1978, now U.S. Pat. No. 4,189,252, the disclosure of which is incorporated herein by reference thereto.

BACKGROUND OF THE INVENTION

1. Field of the Invention

The present invention is directed to an improved structure adapted for undersea construction. The structure is designed to allow for facile assembly and disassembly and is comprised of interlocking members.

2. Description of the Prior Art

The prior art is replete with various arrangements whereby structures adapted for undersea usage are constructed utilizing interlocking arrangements. Such interlock arrangements are described in U.S. Pat. No. 1,701,841, Evers, et al., Feb. 12, 1929; U.S. Pat. No. 1,703,303, Fitzgerald, Feb. 26, 1929; U.S. Pat. No. 1,770,155, Flath, July 8, 1930; U.S. Pat. No. 1,851,959, Huntoon, Mar. 29, 1932; U.S. Pat. No. 2,315,441, McDaniel, Mar. 30, 1943; U.S. Pat. No. 2,820,349, Cooper, Jan. 21, 1958; U.S. Pat. No. 2,828,613, Wilson, Apr. 1, 1958; U.S. Pat. No. 2,847,847, Moore, Aug. 19, 1958; U.S. Pat. No. 3,305,982, Steele, Feb. 28, 1967; U.S. Pat. No. 3,348,459, Harvey, Oct. 24, 1967; U.S. Pat. No. 3,379,017, Kusatake, Apr. 23, 1968; U.S. Pat. No. 3,534,518, Zabray, Oct. 20, 1970; and U.S. Pat. No. 4,041,660, Yensen, Aug. 16, 1977.

Multiple component arrangements have been employed in the prior art as illustrated in U.S. Pat. No. 3,953,979 and base members adapted to conform to variable bottom configurations are disclosed in U.S. Pat. No. 4,037,423.

The use of hollow interlocking plastic elements which are fillable with sand, rock, concrete, etc., is disclosed in U.S. Pat. No. 3,886,751.

Situs filling of support elements is disclosed in U.S. Pat. No. 4,009,580.

Structures having central openings are disclosed in U.S. Pat. No. 3,472,031.

However, an overall undersea structure capable of facile assembly and disassembly as provided by the undersea structure herein described has not been heretofore appreciated in the art of undersea platform construction. Nor has the prior art appreciated the use of varying geometrically configured construction components which allow for modification of the overall configuration of an undersea structure so as to adapt one system to multiple uses.

Specifically, the V-Block undersea supporting structure comprising an important aspect of this invention has not heretofore been utilized as a structural element.

By utilizing the multiple component arrangement developed by applicant it is possible to provide an easily assembled and disassembled undersea structure which is capable of enlargement in all directions without disturbing the original structure.

SUMMARY OF THE INVENTION

It is therefore an object of this invention to provide an interlocking system which is adaptable as a multiple use stable underwater supported structure.

It is further object of this invention to provide a multi-component underwater platform structure suitable for fabricating oil drilling platforms, breakwaters, piers, artificial islands, jettys, or dams on hard soil, rock or sandy bottoms.

It is yet a further object of this invention to provide an underwater structure which can be enlarged in all directions.

It is a still further object of this invention to provide an interlocking underwater structure which is easily assembled and disassembled and which can incorporate as a component thereof sand or other heavy particulate matter available at the site of erection.

Each of the components of the platform may, depending on the structural requirements be fabricated of metal such as steel, preferably treated to avoid corrosion; concrete, generally reinforced and manufactured utilizing casting techniques; plastic, generally reinforced utilizing fibers such as fiberglass woven or nonwoven; and, other ceramic types of structural materials. The individual components of the platform may be fabricated of the same or differing materials.

The foundation block utilized in the platform comprises a rectahedral parallelpiped the opposite faces of which are concave and convex, respectively. The opposite faces are sized and shaped to interengage matingly. Such structure allows for a plurality of said foundation blocks to be interfitted into a three-dimensional array. The concave and convex faces of the foundation block may be quadrangular-pyramidal in shape. A central vertical hole is generally provided, extending from the center of one face to the center of the opposite face. Two diametrically opposed slots for the insertion of a lifting device may be provided which extend radially from the central vertical hole beginning at one face and extending part way down the length of the hole, terminating in a lifting ledge extending radially of the hole and circumferentially of the slots. Using the foregoing arrangement a T-shaped lifting device can be inserted into the hole with its ears extending into the slots. The T-shaped lifting device may then be moved axially of the hole until its ears are beneath the lifting ledge. Thereafter, the T-shaped lifting device can be rotated circumferentially of the hole until its ears have passed beyond the slots into position to engage said lifting ledge to thereby facilitate the installation of the foundation block. The foundation block may have a detent means on the lifting ledge thereof for temporarily engaging the lifting device, preventing unintended circumferential movement of the lifting device during installation of the foundation block. The foundation block is optionally hollow and is provided with at least one filling port, whereby the block can be filled with ballast at the construction location. The filling port may be covered with a removable plate, whereby the block can be maintained watertight and bouyant until the plate is removed. The configuration of the foundation block best adapted for underwater platform construction is one wherein the three concave sides are adjacent to one another in a L-shaped pattern and the three convex sides are adjacent to one another in an interlocking L-shaped pattern.

The foregoing foundation cube unit is supported by and interfits with a base pad unit which has an upper multi-pyramidal surface comprised of a plurality of pyramidal convex faces. Each of the pyramidal convex faces of the base pad unit engage with a pyramidal concave surface of the foundation cubes. The upper multi-pyramidal surface suitably is comprised of twelve pyramidal convex faces.

The bottom surface of the base pad unit opposite the upper multi-pyramidal horizontal surface has a V-shaped central portion adapted to fit into the V-shaped opening extending downwardly from the plane formed by the upper arms 100 of two interconnected V-Blocks. The bottom surface of the base pad unit also has four protruding lugs at each of the four corners sized and shaped to fit into upper arm bridge wedge interlock recesses of a V-Block. The lugs are situated and sized to provide for placement of adjacent base-pad lugs into the upper arm bridge wedge interlock recess of interlocked V-Blocks.

The horizontal surfaces of the bottom surface of the base pad unit rest on the underlying V-Block upper arms.

The configuration of the bottom surface may be varied in accordance with the shapes adopted for the V-Block and the placement of the upper arm bridge wedge interlock recesses and holes extending downwardly from the apex of one or more of the pyramidal convex faces of the base pad may optionally be present.

The V-Block which in cross-section resembles a V is called a V-shaped member. At the point of the V is an elongated element herein denoted as the anchor. The two legs of the V-shaped member are unequal in length. An upper arm extends outwardly from the V at the terminus of the long leg and a lower arm extends outwardly at the terminus of the short leg.

The anchor has a forward and rearward part. The upper part of the anchor is situated internally within the V and the lower part of the anchor forms the point of the V.

The forward part of the anchor has a protuberance on the upper part thereof and a recess on the lower part, which recess is situated below the protuberance. The rearward part of the anchor also has a protuberance on the upper part thereof and a recess on the lower part, said recess being situated below the protuberance.

The dimensions of the protuberances and recesses are such that they interfit one with the other and such protuberances and recesses are the means by which a V-Block is interlocked with V-Blocks situated forwardly and rearwardly of same. For example, the protuberance of the forward part of a first V-Block anchor engages the recess of the rearward part of the anchor of a V-Block situated forward and upward of said first V-Block anchor. The recess of the forward part of said first V-Block anchor is engaged be the protuberance of the rearward part of the anchor of a V-Block situated forward and downward of said first V-Block anchor. The protuberance of the rearward part of the anchor of the first V-Block engages the recess of the forward part of the anchor of a V-Block situated rearward and upward of said first V-Block anchor. The recess of the rearward part of the anchor of the first V-Block is engaged by the protuberance of the forward part of the anchor of a V-Block situated rearward and downward of said first V-Block anchor.

The upper arm which extends outwardly from the terminus of the long leg of the V-Block has a forward and rearward portion. The forward and rearward portions as with the anchor may suitably be on different planes with the rearward portion being on the lower plane.

The forward part of the upper arm has at least one recess on the upper surface thereof and a protuberance on the lower surface located below that recess.

The rearward part of the upper arm has at least one recess on the upper surface thereof. It is also contemplated that the rearward part of the upper arm may optionally have a protuberance disposed on the lower surface thereof which may in some adaptation provide for further interlocking of the V-Blocks.

The lower arm which extends outwardly from the terminus of the short leg of the V-Block has a forward and rearward portion. The forward and rearward portions as with the anchor may suitably be on different planes with the rearward portion being on the lower plane.

The forward part of the lower arm has at least one recess on the upper surface thereof and a protuberance on the lower surface located below that recess.

The rearward part of the lower arm has at least one recess on the upper surface thereof. It is also contemplated that the rearward part of the lower arm may optionally have a protuberance disposed on the lower surface thereof which may in some adaptation provide for further interlocking of the V-Blocks.

When the V-Blocks are placed side-by-side the engagement of protuberances and recesses of upper and lower arms respectively provide for stability along the axis normal to anchor interlinkage.

The V-Blocks are vertically placed one upon the other to provide in an equally facile manner an overall rigid construction suitable for shallow, middle depth or extremely deep water use.

Placement of the V-Blocks may be accomplished without any requirement for divers and the depth of construction is limited only by the length of wire cable utilized to position/deposit the blocks into position.

Lowering of the V-Blocks may be affected by crane using underwater flood lights and closed circuit T.V. cameras which insure the proper placement of the V-Blocks.

Suitably the V-Block construction system can be used for:

1. Mid ocean stormproof oil drilling platforms.
2. Offshore oil storage and tanker mooring.
3. Deep water electrical generating platforms—OTEC—(Ocean Thermal Energy Conversion).
4. Offshore airfields with integral fuel storage facilities.
5. Offshore (or lake) missile silos.
6. Offshore submarine pens.
7. Deep water caissons.
8. Deep water artificial islands.
9. Artificial reefs and shore erosion control.
10. Mariculture tanks.

BRIEF DESCRIPTION OF THE DRAWINGS

FIG. 1 is a side elevational view illustrating the entire structure with the interlocking components in place.

FIG. 2 is a vertical sectional view taken along line 2—2 of FIG. 5.

FIG. 3 is a vertical sectional of FIG. 4.

DETAILED DESCRIPTION OF THE PRESENTLY PREFERRED EMBODIMENTS

The overall structure shown in FIG. 1 comprises V-Blocks 99 underlying base pad units 50 in turn supporting foundation cube units 16.

Figure 6:
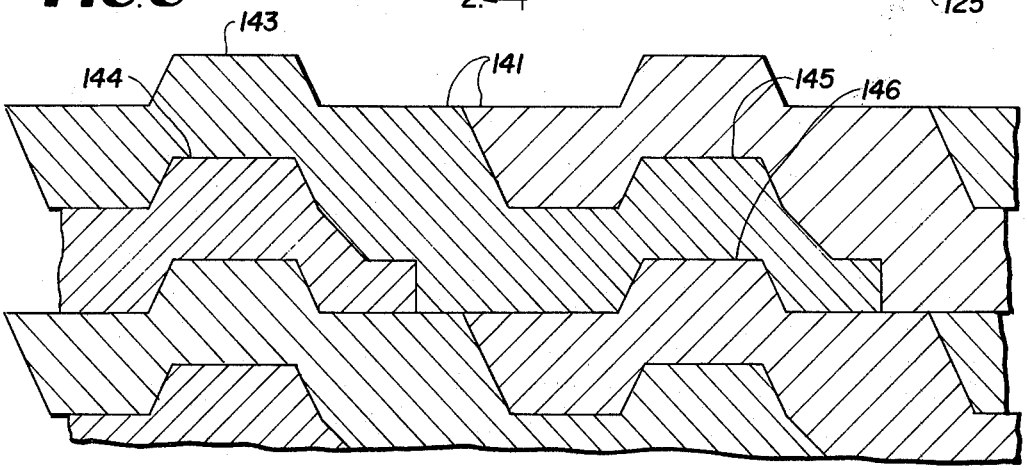
FIG. 6 is a vertical sectional of interlinked V-Blocks taken along line 6—6 of FIG. 2.
Figure 7:
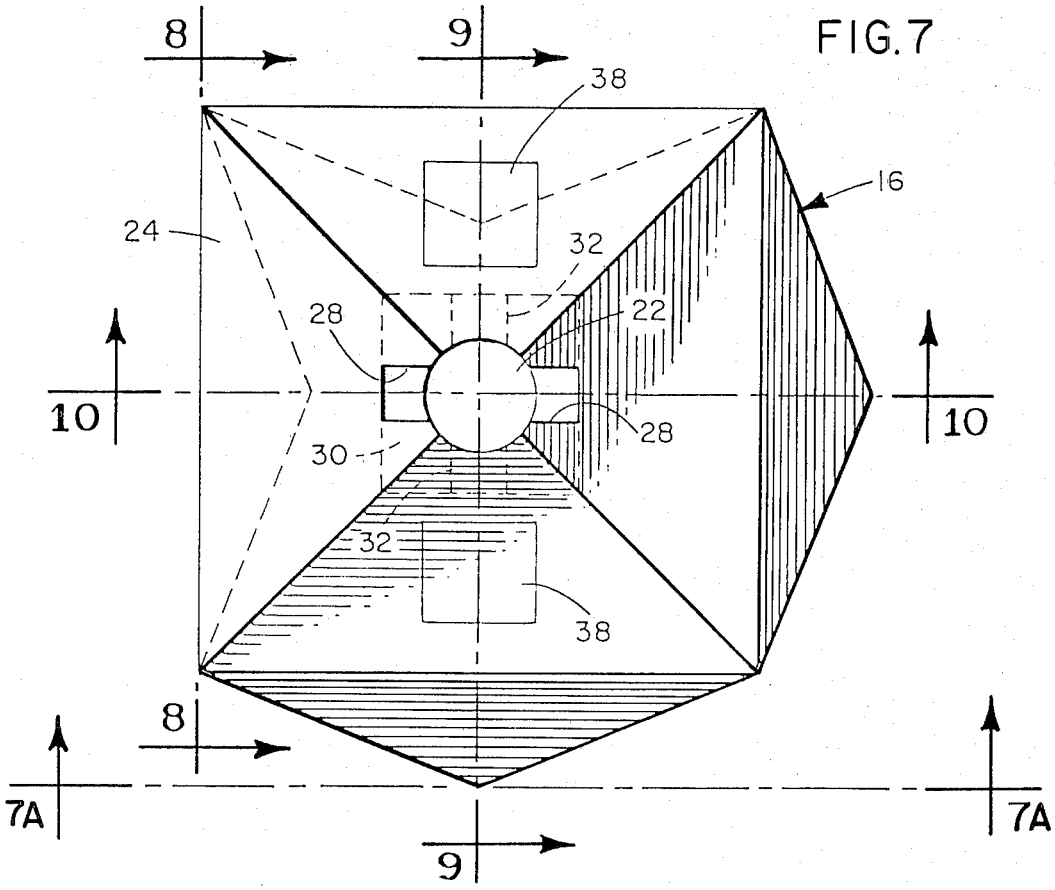
FIG. 7 is a top plan view of a Foundation Cube Unit.
Figure 7A:
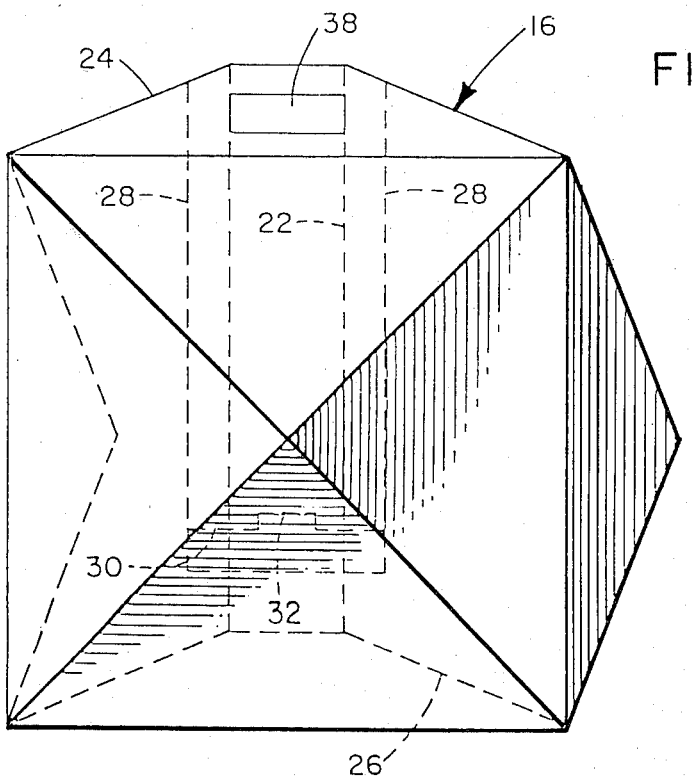
FIG. 7A is a side elevation taken along line 7—7 of FIG. 7.
Figure 8:
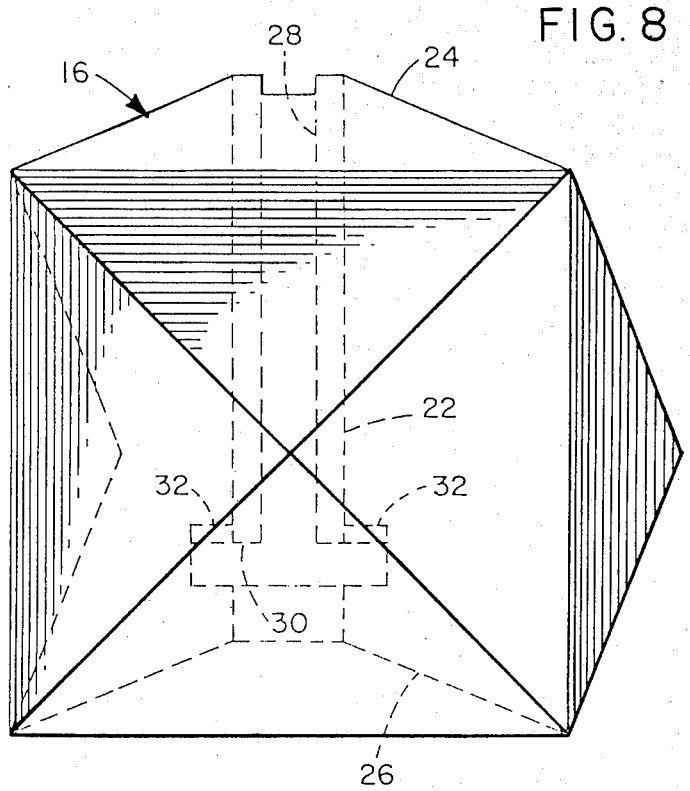
FIG. 8 is a side elevation taken along the line 8—8 in FIG. 7.

FIG. 6 illustrates specifically the interlocking of V-Blocks 99.

Each of FIGS. 1 and 6 will be returned to subsequently after the individual components have been described in detail.

The Foundation Cube Units 16

The foundation cube units 16 shown in FIGS. 7–11 comprise rectahedral parallelepipeds the opposite faces of which are concave and convex, respectively. The corresponding faces may be termed "pyramidal concavities or convexities." As best seen in FIG. 1, the opposite faces of the units 16 are sized and shaped to interengage matingly, allowing a plurality of the units 16 to be interfitted into a three-dimensional array. To accomplish this, the three concave sides are adjacent to one another in an L-shaped pattern, and the three convex sides are adjacent to one another in an interlocking L-shaped pattern. Preferably, the concave and convex faces are quadrangular-pyramidal in shape, although other suitable shapes may be used.

A central vertical hole 22 is provided extending from the center of one face 24 to the center of the opposite face 26. Two diametrically opposed slots 28 are provided extending radially from the central vertical hole 22 beginning at the face 24 and extending part way down the length of the hole 22. The slots 28 terminate in a lifting ledge 30 extending radially of the hole 22 and circumferentially of the slots 28. The hole 22, the slots 28, and the lifting ledge 30 permit a T-shaped lifting device (not shown) to be inserted into the hole 22 with its ears extending into slots 28, moved axially of the hole 22 until its ears are beneath the lifting ledge 30, rotated circumferentially of the hole 22 until its ears have passed the slots 28 into position to engage the lifting ledge 30, and used to install the unit 16. Preferably the unit 16 further comprises a detent means on the lifting device during installation of the foundation unit 16. As shown, the detent means can conveniently comprise a downwardly open notch 32 in the lifting ledge 30 sized and shaped to receive the ears of the T-shaped lifting device.

Figure 9:
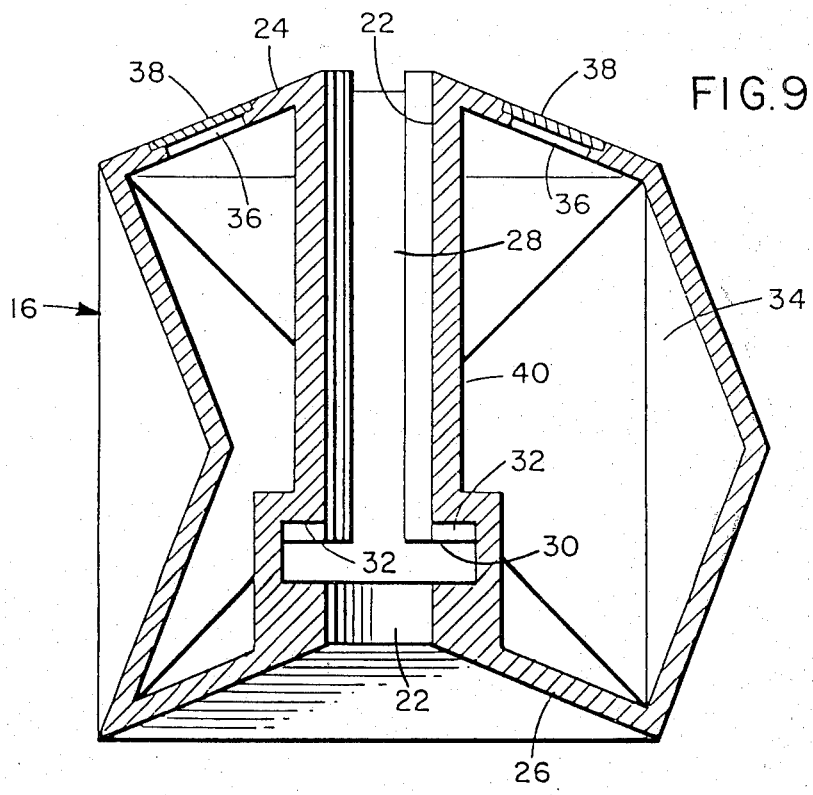
FIG. 9 is a vertical sectional view taken along the line 9—9 in FIG. 7.
Figure 10:
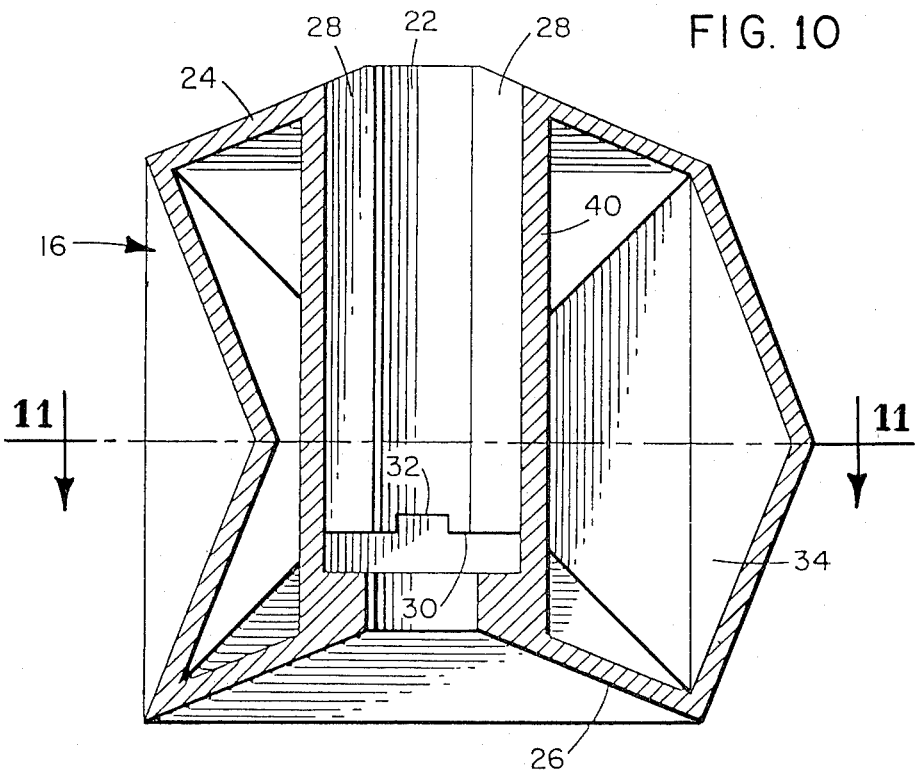
FIG. 10 is a vertical sectional taken along line 10—10 in FIG. 7.
Figure 11:
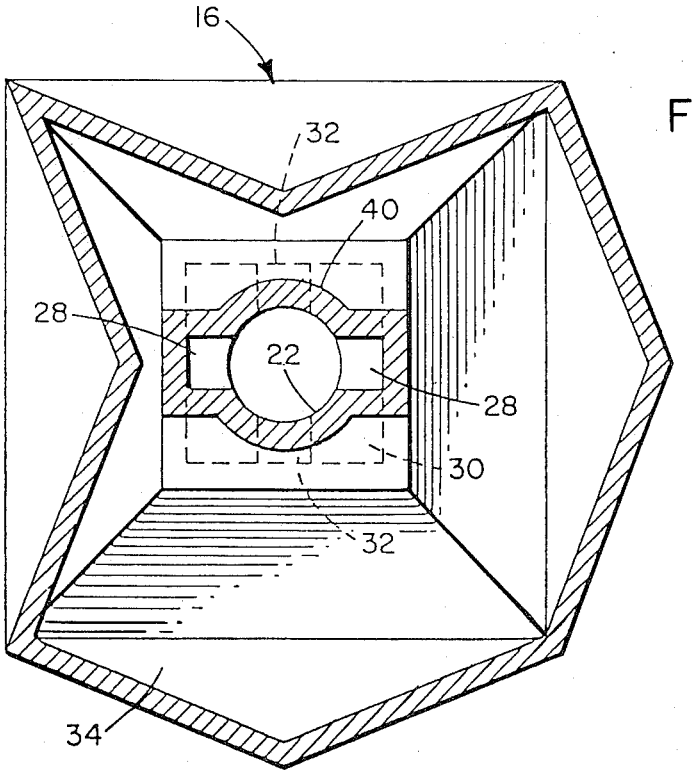
FIG. 11 is a horizontal sectional view taken along the line 11—11 of FIG. 10.

In its preferred embodiment, the unit 16 is hollow at 34 and is provided with at least one filling port 36 which can be used to fill the block with ballast at the construction location. As best seen in FIG. 9, the filling ports 36 are covered with removable plates 38 so that the unit 16 can be maintained water-tight and bouyant until the plates 38 are removed. In this embodiment, which has both a central vertical hole 22 and a hollow 34, an internal wall 40 defines the hole 22 and extends from the face 24 to the face 26.

As best shown in the specific embodiment of the invention illustrated in FIG. 1, holes 22 of foundation units 16 align with holes in base pad unit 50 and V-Block unit 2.

The Base Pad Units 50

Figure 4:
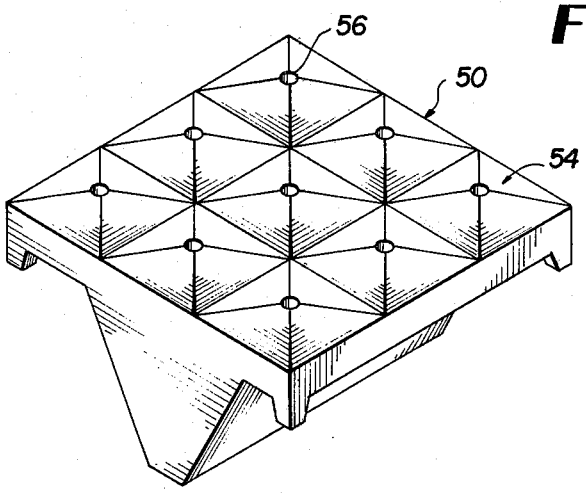
FIG. 4 is a perspective view of a Base Pad Unit.

The base pad units 50 shown in FIGS. 3 and 4 comprises an upper multi-pyramidal horizontal surface 52, having a plurality of pyramidal convex faces 54 adapted to engage the pyramidal concave surfaces 26 of foundation cubes 16. Twelve of said faces are suitably arranged on the upper horizontal surface 52 as depicted in FIG. 4. The faces are preferably quadrangular-pyramidal in shape. Suitably where downward access is desired, one or more of the convex faces have central vertical holes 56 which in use align with and interconnect the vertically situated holes in the V-Block supporting structure and the vertically situated holes 22 of cubes 16.

The bottom surface of base pad unit 50 opposite the upper multi-pyramidal horizontal surface has a V-shaped central portion 58 adapted to fit into the V-shaped opening 146 extending downwardly from the plane formed by the upper arms 100 of two interconnected V-Blocks. The opposite face 60 of base pad unit 50 also has four protruding lugs 62 sized and shaped to fit into upper arm bridge wedge interlock recess 104. The lugs 62 are situated and sized to provide for placement of adjacent base-pad lugs into the upper arm bridge wedge interlock recess 104 of interlocked V-Blocks. The two horizontal surfaces 62 and 64 of base pad unit 50 rest on underlying V-Block upper arms 100.

The configuration of the bottom surface may be varied in accordance with the shapes adopted for the V-Block and the placement of the upper arm bridge wedge interlock recesses 104.

The V-Block

The V-Block 99 which in cross-section resembles a V is called a V-shaped member. At the point of the V is an elongated element herein denoted as the anchor 141. The two legs 101, 111 of the V-shaped member are unequal in length. Upper arm 100 extends outwardly from the V at the terminus of long leg 101, and lower arm 120 extends outwardly at the terminus of short leg 111.

The anchor 141 has a forward and rearward part. The upper part of the anchor defines the lowermost internal surface of the V and the lower part of the anchor forms the point of the V.

The forward part of the anchor has a protuberance 143 on the upper part thereof and a recess 144 in the lower part, which recess 144 is situated below the protuberance 143. The rearward part of the anchor also has a protuberance 145 on the upper part thereof and a recess 146 in the lower part, said recess 146 being situated below the protuberance 145.

The dimensions of the protuberances and recesses are such that they interfit one with the other and such protuberances and recesses are one means by which a V-Block is interlocked with V-Blocks situated forwardly and rearwardly of same. For example, the protuberance of the forward part of a first V-Block anchor engages the recess of the rearward part of the anchor of a V-Block situated forward and upward of said first V-Block anchor. The recess of the forward part of said first V-Block anchor is engaged by the protuberance of the rearward part of the anchor of a V-Block situated forward and downward of said first V-Block anchor. The protuberance of the rearward part of the anchor of the first V-Block engages the recess of the forward part of the anchor of a V-Block situated rearward and upward of said first V-Block anchor. The recess of the rearward part of the anchor of the first V-Block is engaged by the protuberance of the forward part of the anchor of a V-Block situated rearward and downward of said first V-Block anchor.

Upper arm 100 which extends outwardly from the terminus of long leg 101 of V-Block 99 has a forward 103 and rearward 105 portion. Forward 103 and rearward 105 portions, as with the anchor, may suitably be on different planes with the rearward portion, as illustrated, being on the lower plane.

Figure 5:
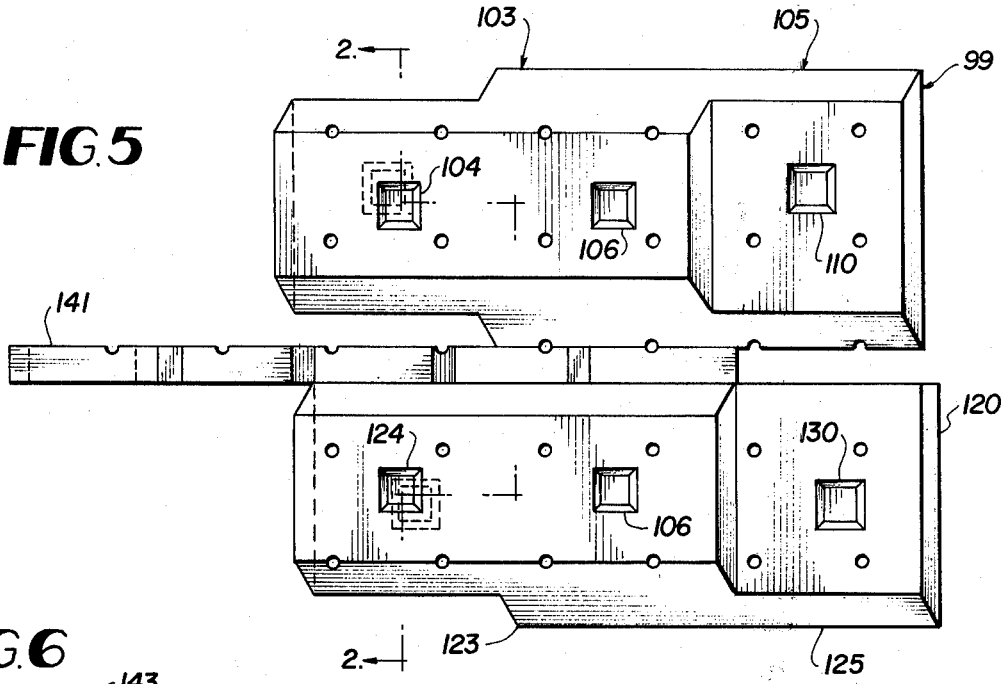
FIG. 5 is a top plan view of a V-Block.

Forward part 103 of upper arm 100 has at least one recess 104 in the upper surface thereof and a protuberance 102 on the lower surface located below that recess. A second recess 106, illustrated in FIG. 5, may also be provided with the respective protuberance located thereunder on the lower surface.

The rearward part 105 of the upper arm has at least one recess 110 in the upper surface thereof. It is also contemplated that the rearward part of the upper arm may optionally have a protuberance (not shown) disposed on the lower surface thereof which may in some adaptation provide for further interlocking of the V-Blocks.

Lower arm 120 which extends outwardly from the terminus of short leg 111 of V-Block 99 has a forward 123 and rearward 125 portion. Forward 123 and rearward 125 portions, as with the anchor, may suitably be on different planes with the rearward portion, as illustrated, being on the lower plane.

Forward part 123 of lower arm 120 has at least one recess 124 in the upper surface thereof and a protuberance 122 on the lower surface located below that recess. A second recess 130, illustrated in FIG. 5, may also be provided with the respective protuberance located thereunder on the lower surface.

The rearward part 125 of the lower arm 120 has at least one recess 130 in the upper surface thereof. It is also contemplated that the rearward part of the lower arm may optionally have a protuberance disposed on the lower surface thereof which may in some adaptation provide for further interlocking of the V-Blocks.

When the V-Blocks are placed side-by-side the engagement of protuberances and recesses of upper and lower arms respectively provide for stability along the axis normal to anchor interlinkage.

As best illustrated by reference to FIGS. 1 and 6, each V-Block in the overall structure will interlock with other V-Blocks adjacent thereto along every axis. A platform of interlocked V-Blocks can provide a uniform monolithic structure if desired. The V-Blocks can also be utilized to form a structure with a hollow central area, with or without an integral V-Block bottom depending on the final use of the platform.

A structure with an integral bottom for a hollow area can be retained virtually waterproof, after the water in it has been evacuated, especially if a waterproof casket material is applied to the surrounding interlocking surfaces of the V-Blocks.

Also as illustrated in FIGS. 1 to 4, alignment of vertical central hole 22 of the foundation cube 16, to central vertical hole 56 of base pad unit 16 and the central vertical hole 200 of the V-Block optionally allows for a shaft to communicate over the entire depth of the platform. The placement of holes may, of course, be varied depending on requirements.

It is not intended to limit the invention to the details heretofore recited, the invention being defined in the claims which follow.

I claim:

1. An integral V-Block suitable as a component for a stabile construction comprising:

(a) an elongated lower anchor member having a forward and rearward portion along the length thereof; said forward portion having a first protuberance on the upper part thereof and a first recess on the lower part thereof, which first recess is situated below the first protuberance; and, said rear portion having a second protuberance on the upper part thereof and a second recess on the lower part thereof, which second recess is situated below the second protuberance;

(b) two legs of unequal length contiguous with and extending upwardly and outwardly from said elongated lower anchor member, describing a V-shaped volume with said anchor; one of said legs being a short leg and another of said legs being a long leg, said long leg terminating further from said elongated lower anchor member than the short leg;

(c) a first upper arm contiguous with and extending outwardly from the terminus of the long leg, said first upper arm having a second forward portion with a third upper surface and a third lower surface and a second rearward portion with a fourth upper surface and fourth lower surface;

(d) a second upper arm contiguous with and extending outwardly from the terminus of the short leg; said second upper arm having a third forward portion with a fifth upper surface and a fifth lower surface and a third rearward portion with a sixth upper surface and a sixth lower surface;

(e) a third recess in the third upper surface and a third protuberance on the third lower surface, which third protuberance is situated below the third recess;

(f) a fourth recess in the fourth upper surface and a fourth protuberance on the fourth lower surface, which fourth protuberance is situated below the fourth recess;

(g) a fifth recess in the fifth upper surface and a fifth protuberance on the fifth lower surface, which fifth protuberance is situated below the fifth recess;

(h) a sixth recess in the sixth upper surface and a sixth protuberance on the sixth lower surface, which sixth protuberance is situated below the sixth recess.

2. The integral V-Block of claim 1 further characterized in that the third upper surface of the second forward portion of the first upper arm and fourth upper surface of the second rearward portion of the first upper arm are on different planes, said fourth upper surface being on a plane below that of the third upper surface.

3. The integral V-Block of claim 2 further characterized in that the distance between the planes formed by the third and fourth upper surfaces is equal to the distance between the third upper surface and third lower surface.

4. An undersea platform construction comprising:

(1) a plurality of foundation blocks, each of said foundation blocks comprising a rectahedral parallelepiped opposite faces of which are concave and convex, respectively, the opposite faces being sized and shaped to interengage matingly, said foundation blocks being interfitted into a three-dimensional array;

(2) a plurality of base pad units supporting said foundation blocks, said base pads comprising: (a) an upper multi-pyramidal horizontal surface having a plurality of rectahedral parallelepiped convex faces being sized and shaped to interengage matingly with a concave parallelepiped concave face of a foundation block; and (b) a bottom surface adapted to fit into the V-shaped opening formed by a plurality of interconnected V-Blocks; and, (3) a plurality of interlocked V-Blocks supporting said base pad units each of said V-Blocks comprising:

(a) an elongated lower anchor member having a forward and rearward portion along the length thereof; said forward portion having a first protuberance on the upper part thereof and a first recess on the lower part thereof, which first recess is situated below the first protuberance; and, said rear portion having a second protuberance on the upper part thereof and a second recess on the lower part thereof, which second recess is situated below the second protuberance;

(b) two legs of unequal length continguous with and extending upwardly and outwardly from said elongated lower anchor member, describing a V-shaped volume with said anchor; one of said legs being a short leg and another of said legs being a long leg, said long leg terminating further from said elongated lower anchor member than the short leg;

(c) a first upper arm contiguous with and extending outwardly from the terminus of the long leg, said first upper arm having a second forward portion with a third upper surface and a third lower surface and a second rearward portion with a fourth upper surface and fourth lower surface;

(d) a second upper arm contiguous with and extending outwardly from the terminus of the short leg; said second upper arm having a third forward portion with a fifth upper surface and a fifth lower surface and a third rearward portion with a sixth upper surface and a sixth lower surface;

(e) a third recess in the third upper surface and a third protuberance on the third lower surface, which third protuberance is situated below the third recess;

(f) a fourth recess in the fourth upper surface and a fourth protuberance on the fourth lower surface, which fourth protuberance is situated below the fourth recess;

(g) a fifth recess in the fifth upper surface and a fifth protuberance on the fifth lower surface, which fifth protuberance is situated below the fifth recess;

(h) a sixth recess in the sixth upper surface and a sixth protuberance on the sixth lower surface, which sixth protuberance is situated below the sixth recess.

5. The undersea platform of claim 4 further characterized in that the third upper surface of the second forward portion of the first upper arm and fourth upper surface of the second rearward portion of the first upper arm are on different planes, said fourth upper surface being on a plane below that of the third upper surface.

* * * * *